US005372272A

United States Patent [19]

Jennings

[11] Patent Number: 5,372,272

[45] Date of Patent: Dec. 13, 1994

[54] BAG DISPENSING WASTE RECEPTACLE

[76] Inventor: Gary W. Jennings, 5709 E. Belknap #1175, Ft. Worth, Tex. 76117

[21] Appl. No.: 22,284

[22] Filed: Feb. 25, 1993

[51] Int. Cl.[5] ..... B65D 30/00

[52] U.S. Cl. ..... 220/407

[58] Field of Search ..... 220/407, 458

[56] References Cited

U.S. PATENT DOCUMENTS

| | | | |
|---|---|---|---|
| 3,300,082 | 1/1967 | Patterson | 220/407 |
| 3,451,453 | 6/1969 | Heck | 220/407 |
| 4,657,176 | 4/1987 | Matsubara | 221/41 R |
| 4,721,226 | 1/1988 | Yurko | 220/407 |
| 4,823,979 | 4/1989 | Clark | 220/407 |
| 5,031,793 | 7/1991 | Chen et al. | 220/407 |

FOREIGN PATENT DOCUMENTS 3701363 1/1987 Germany .

*Primary Examiner*—Joseph Man-Fu Moy
*Attorney, Agent, or Firm*—Charles A. Bevelacqua

[57] ABSTRACT

This invention discloses a waste receptacle comprising a waste receiving volume. The bag storing volume is defined by at least two axially opposed generally planar second vertical sidewalls of lesser height than the height of the first upwardly extending sidewalls, two of the second vertical sidewalls extending generally parallel to each other and defining a first horizontal dimension of the bag storing volume, a bottom portion closing the bottom of the waste receptacle, the bottom portion including portions integrally joined with the first upwardly extending sidewalls and with the second vertical sidewalls and forming a connection between them, the first horizontal dimension of the bag storing volume being substantially smaller than a corresponding second horizontal dimension between the first upwardly extending sidewalls measured along a line lying in a vertical plane extending between and substantially perpendicular to the two second vertical sidewalls, and the bottom portion lying between the at least two vertical sidewalls further having a central raised portion providing a platform for supporting a supply of disposable bags to be stored in the waste receptacle.

18 Claims, 2 Drawing Sheets

BAG DISPENSING WASTE RECEPTACLE

FIELD OF INVENTION

This invention relates to waste receptacles and particularly to such receptacles with provision for storing disposable bags which are used to line the receptacle.

BACKGROUND OF THE INVENTION

It is common practice to provide waste receptacles with disposable liners which can be removed with the waste to be discarded, leaving the waste receptacle ready for reuse. Usually the disposable liners are in the form of bags which are made of a relatively thin plastic material and are either joined to each other with a perforation so that the used bag can be easily separated from a new bag or are interfolded so that pulling a used bag automatically pulls the next bag from a store of bags or a container in which the bags are supplied. In current practice such disposable bags are commonly supplied in a box which is made of cardboard or the like. The box is usually rectangular in shape and has a height of substantially smaller dimension than its width or length. In some cases bags are supplied in a continuous roll, particularly in the case of the type which are joined together by a perforated portion. These rolls of bags may not be supplied in separate boxes.

Previous attempts have been made to provide a waste receptacle with provision for storing a supply of bags within the receptacle itself. In some cases an opening is provided from the outside to the inside of the waste receptacle at or near, the bottom of the receptacle. In others complicated dispensing apparatus is involved. Both of these approaches may require complicated and expensive molds and other manufacturing apparatus which make the finished product expensive and impractical. In still other cases the waste receptacle is made in two or more parts which must be separated to install a new supply of bags or to obtain the next bag in the event that the new bag does not automatically feed into the waste receptacle for any reason.

SUMMARY OF THE INVENTION

This invention discloses a waste receptacle comprising a waste receiving volume or portion open from the top and defined on its sides by integrally joined first upwardly extending sidewalls, a bag storing volume or portion at the bottom of the waste receptacle and accessible only through the open top of the waste receiving volume for storing a supply of interconnected disposable trash bags, the bag storing volume being defined by at least two axially opposed generally planar second vertical sidewalls of lesser height than the height of the first upwardly extending sidewalls, two of the second vertical sidewalls extending generally parallel to each other and defining a first horizontal dimension of the bag storing volume, a bottom portion closing the bottom of the waste receptacle, the bottom portion including portions integrally joined with the first upwardly extending sidewalls and with the second vertical sidewalls and forming a connection between them, the first horizontal dimension of the bag storing volume being substantially smaller than a corresponding second horizontal dimension between the first upwardly extending sidewalls measured along a line lying in a vertical plane extending between and substantially perpendicular to the two second vertical sidewalls, and the bottom portion lying between the at least two vertical sidewalls further having a central raised portion providing a platform for supporting a supply of disposable bags to be stored in the waste receptacle.

The receptacle is constructed so that it can be made in one piece from moldable plastic material such as, for example, polypropylene or polyethylene, in a relatively simple one or two piece mold. This reduces the cost of the mold and manufacture of the product so that the receptacle can be sold in competition with waste receptacles not having a bag dispensing feature. The bags or the box or other container of bags is placed in the bottom of the waste receptacle through the same top opening through which waste material is placed in the receptacle. No special openings through the sidewalls of the receptacle are needed and access to the bag storing volume is easy and uncomplicated.

In an alternative construction there is also provided a removable platform which supports waste placed in the waste receptacle and helps to avoid crushing the box in which the supply of bags is contained. The platform also helps to keep liquids placed in the receptacle or draining from other material placed in the waste receptacle from entering or penetrating the box or supply of bags. The platform is formed with an opening or slot through which a bag from the supply of bags can enter the waste containing or upper portion of the receptacle. The removable platform may be supported on structure incorporated in the main body of the receptacle or may itself be provided with supporting members which serve to support the platform as well as to maintain a box or other supply of bags in position in the bottom of the receptacle and in orientation with the opening or slot in the platform.

Alternative constructions of the structure for retaining a box or other supply of bags is also shown. Preferably the structure for holding a box or supply of bags is integrally formed with the bottom of the receptacle and is adapted to contact the box or other supply of bags on at least two opposing sides. Constructions which contact the box or supply of bags on four sides are also shown for both the construction in which the supply of bags is retained in position by structure in the bottom of the waste receptacle and the construction in which the supply of bags is retained in position by structure of the bottom of a removable platform.

It is an object of this invention to provide a bag dispensing waste receptacle having a relatively simple design which is economical to manufacture and which can receive a box or other supply of disposable bags through the same top opening through which waste material is placed.

Another object of the invention is to provide a waste receptacle wherein removal of a used disposable bag will cause a new disposable bag to be drawn into the receptacle from the space in which it is stored.

It is a further object of this invention to provide a waste receptacle with provision for storing a supply of disposable bags or a container containing a supply of such bags.

Yet another object of this invention is to provide a waste receptacle having structure for supporting waste material placed in the receptacle out of contact with the stored bags or with a container in which the bags are stored.

Still another object of the invention is to provide a waste receptacle with provision for storing a supply of disposable bags and having a platform for at least partially protecting the supply of bags or a container in which such supply of bags are enclosed from liquids included in the waste material placed in the receptacle.

These and various other objects and advantages of the present invention will become more readily apparent to those persons who are skilled in the art from the following more detailed description of the invention, particularly, when such description is taken in conjunction with the attached drawings and with the appended claims.

DESCRIPTION OF THE INVENTION

Figure 1:
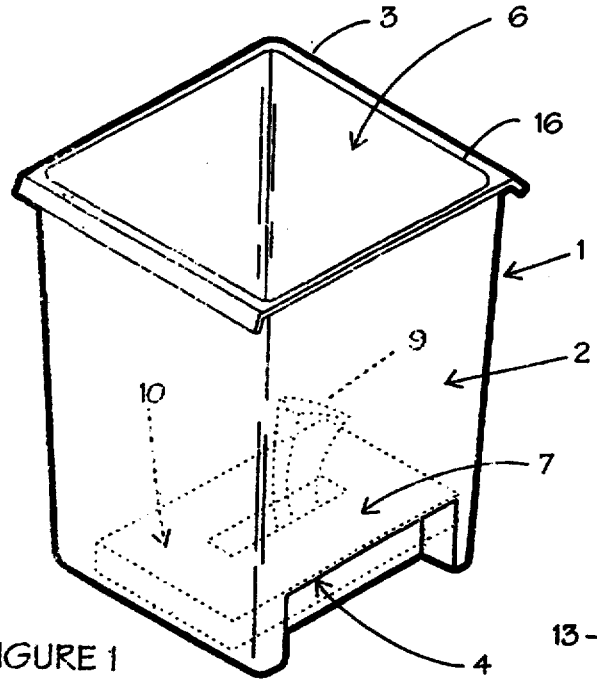
FIG. 1 is an isometric view of a preferred form of a waste receptacle of the invention with a box of disposable bags indicated by dotted lines.

Prior to proceeding to a more detailed description of the various preferred and alternative embodiments of the present invention it should be noted that, for the sake of clarity, identical components which have identical functions have been identified with identical reference numerals throughout the several views illustrated in the drawings.

Figure 2:
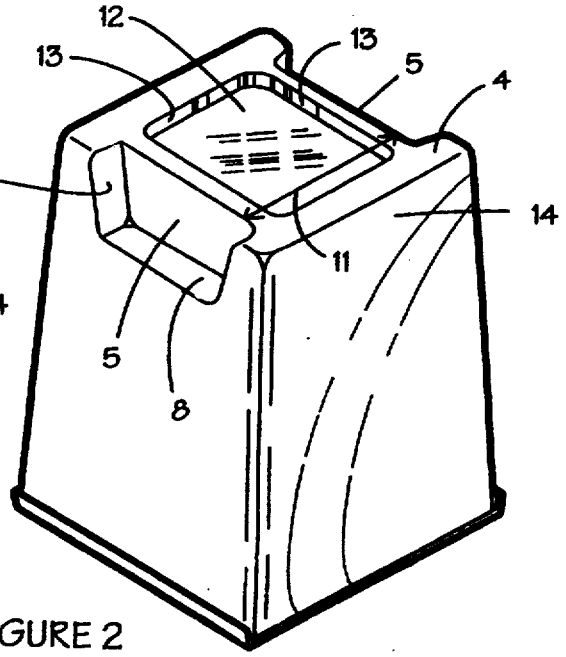
FIG. 2 is an isometric view of the waste receptacle of FIG. 1 shown from the bottom.

Referring now particularly to FIGS. 1 and 2 of the drawings, there is illustrated a waste receptacle indicated generally by the numeral 1 and having generally upwardly extending sidewalls 2 defining a waste containing portion or volume 6 which is accessible through a top opening 3.

The waste receptacle 1 has a bottom portion 4 and adjacent the bottom portion 4 is a bag storing portion or volume 7 defined generally by vertical sidewalls 5, lower portion 14 of sidewalls 2 of the receptacle 1, the bottom portion 4 and raised portion 12 of bottom portion 4. Bottom portion 4 also comprises a connecting portion 8 which connects vertical sidewalls 5 to upwardly extending sidewalls 2. Vertical connecting portions 15 complete the enclosure of the bottom of the waste receptacle. As illustrated in FIG. 1, a commercially available box or container of bags such as box 10 or other container containing disposable trash bags 9 is placed on raised portion 12 of bottom portion 4 where it will be held in position by vertical sidewalls 5 and upwardly extending sidewalls 2. In use, a bag 9 is pulled upwardly from container 10 and the top edge of the bag may be deployed around the top rim 16 so that the bag will receive waste material. When it is desired to change the disposable bag it is taken out of the waste receptacle through the top opening 3 to be discarded with its contents. If it is of the type where the bags are joined by a perforated portion, the new bag is separated from the used bag and deployed around the top rim 16 as previously described. If the bags are of the interfolded type, the new bag will lay at the bottom of the waste containing volume and can be pulled up and deployed as previously described.

Figure 3:
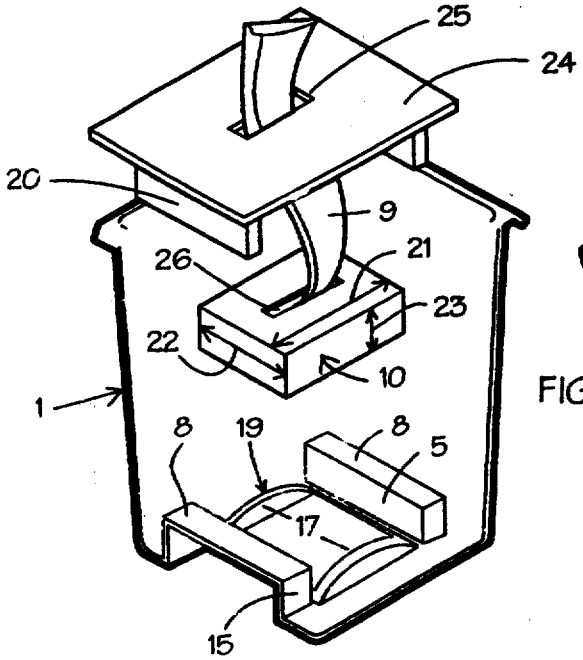
FIG. 3 is an interior exploded view of a modified form of waste receptacle of the invention which has a removable waste support platform with portions of the sidewalls of the waste receptacle deleted for clarity.

Referring now to FIG. 3, there is shown another preferred embodiment of the invention which in addition to vertical sidewalls 5 includes a second pair of vertical sidewalls 19 formed by molding a depression 20 in the bottom of the waste receptacle 1. Vertical sidewalls 19 have inner walls 17 and outer walls 18. Preferably the space 11 between vertical sidewalls 5 is approximately equivalent to the dimension 21 of the commercially available box 10 of disposable bags. Similarly the distance between inner walls 17 of the second pair of vertical walls 19 is approximately equivalent to the dimension 22 of a box 10 and the vertical height of vertical sidewalls 5 is at least as great as the dimension 23 of such box 10.

FIG. 3 further shows an optional platform 24 which may be used to separate the waste containing volume 6 from bag storing volume 7 of the waste receptacle. Platform 24 may be of a size and shape to substantially conform to the interior of the sidewalls 2 of the waste receptacle when the platform is resting on a vertical sidewall 5 near the bottom of the waste receptacle. Platform 24 has an opening 25 therethrough which permits bag 9 to pass from the bag storing volume 7 into the waste containing volume 6. In use platform 24 is placed in the waste receptacle 1 so that the length of the slot 26 in the box 10 will coincide with the orientation of the opening or slot 25 in platform 24, as is illustrated in FIG. 3. Platform 24 may, of course, be made somewhat smaller as long as it performs its function of at least partially supporting waste material placed in the top of the waste receptacle 1.

Figure 4:
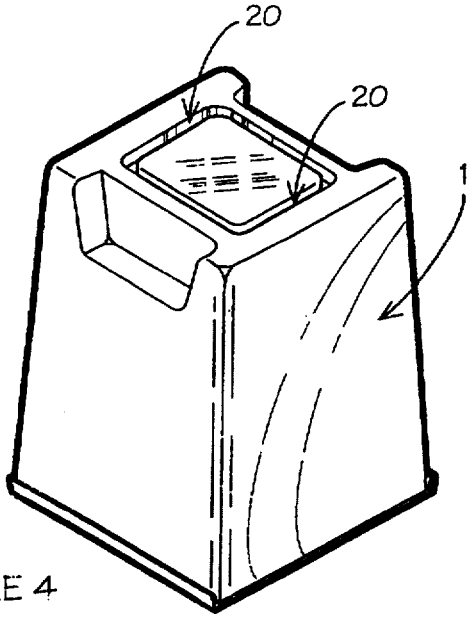
FIG. 4 is a view from the bottom of the waste receptacle shown in FIG. 3.
Figure 5:
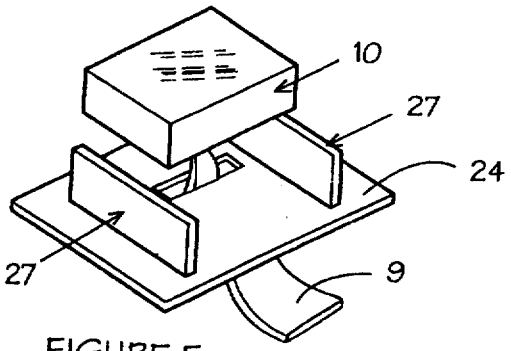
FIG. 5 is a bottom view of the removable platform shown in FIG. 3.

If desired, platform 24 may be provided with vertical sides or projections 27 having a height at least equivalent to the height 23 of box 10 and being spaced from each other by a distance approximately equal to dimension 21 of box 10. In the event that platform 24 is provided with its own support and bag retaining structure, either or both of vertical sidewalls 5 and the second pair of vertical sidewalls 19 in the bag storing portion 7 can be eliminated. The raised portion or bag support platform 12 of bottom portion 4 of the waste receptacle may also be eliminated. However, some or all of such structures, which are shown in FIG. 4, although not entirely necessary, may nevertheless be retained for their function as reinforcing or stiffening structure for the waste receptacle and to provide the user the option of using the receptacle without a platform 24 or using it with either a platform with its own supports or a platform without its own supports. It should also be understood that vertical sidewall 5, vertical sidewall 19 and vertical sides or projections 27 or any one of them, although illustrated as unitary continuous structures, may be formed as a series or group of multiple smaller structures capable of performing the same function as the single structure.

Figure 6:
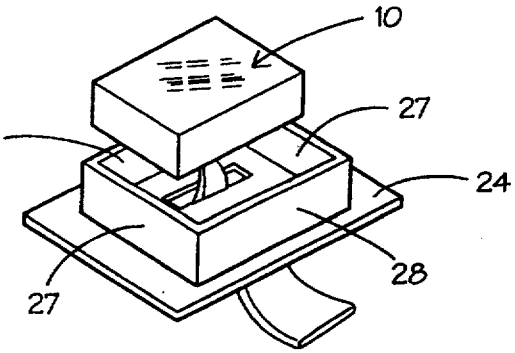
FIG. 6 is a bottom view of another form of removable platform that can be used with the waste receptacle of the invention.

As shown in FIG. 6 platform 24 may be provided with one or more sides 28 additional to the sides 27 previously described to further support platform 24 and help orient container 10.

Figure 7:
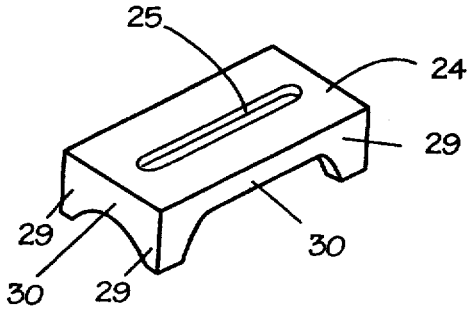
FIG. 7 is a top view of still another form of removable platform that can be used with the waste receptacle of this invention.

FIG. 7 illustrates another configuration which may be used for platform 24 and which would still perform the functions previously described for platform 24.

In the configuration shown in FIG. 7 there is provided a platform 24 having a through opening 25 and a plurality of vertical support members 29 which as shown in FIG. 7 may be placed at several locations around the periphery of the platform 24, for example, at the corners if the platform is rectangular. Side and end members 30 and 31 respectively may also be provided to support the platform 24 at a predetermined height which will permit placement of a supply of disposable bags such as a supply of bags in container 10 under the platform 24. Some or all of the side and end members 30 and 31 may be formed with arcuately shaped cut-out portions if desired. Platform 24 need be only large enough to overly a container, such as box 10, housing a supply of bags.

Although the waste receptacle has bene illustrated as being generally rectangular in shape with relatively flat sides it should be understood that the invention can be adapted to a waste receptacle of a round or other configuration and to other forms of waste receptacles such as, for example, the so called "step on waste can" which has apparatus for remotely raising the lid of the waste receptacle.

While both the presently preferred and alternative embodiments of the invention have been described in detail above, it should be obvious that various other modifications and adaptations of the invention can be made by those person skilled in the art without departing from the spirit and scope of the appended claims.

I claim:

1. A waste receptacle comprising:

a waste receiving volume open from the top and defined on its sides by integrally joined first upwardly extending sidewalls, a bag storing volume at the bottom of said waste receptacle and accessible only through the open top of said waste receiving volume for storing a supply of interconnected disposable bags to be used for containing waste material placed in said waste receptacle, said bag storing volume being defined in part by at least two axially opposed generally planar second vertical sidewalls of lesser height than the height of said first upwardly extending sidewalls, two of said second vertical sidewalls extending generally parallel to each other and defining a first horizontal dimension of said bag storing volume, a bottom portion closing the bottom of said waste receptacle, said bottom portion including portions integrally joined with said first upwardly extending sidewalls and with said second vertical sidewalls and forming a connection between them, said first horizontal dimension of said bag storing volume being substantially smaller than a corresponding second horizontal dimension between said first upwardly extending sidewalls measured along a line lying in a vertical plane substantially perpendicular to said two of said second vertical sidewalls, and said bottom portion further having a central raised portion lying between said at least two second vertical sidewalls providing a platform for supporting a supply of disposable bags to be stored in said waste receptacle.

2. A waste receptacle as set forth in claim 1, wherein said at least two axially opposed second vertical walls comprise two axially opposed pairs of walls.

3. A waste receptacle as set forth in claim 1 wherein said at least two axially opposed generally planar second vertical sidewalls comprise four sidewalls arranged in a substantially rectangular configuration.

4. A waste receptacle as set forth in claim 1:

wherein said at least two axially opposed second vertical sidewalls are constructed and arranged to receive a rectangular container containing disposable bags and to snugly grip at least two opposed sides of such container.

5. A waste receptacle as set forth in claim 1 further comprising a removable platform for supporting trash placed in said waste receptacle, said removable platform being supported in a generally horizontal plane by at least one pair of horizontally opposed substantially vertical side members secured to said removable platform.

6. A waste receptacle as set forth in claim 4 in which the vertical height of at least one pair of said horizontally opposed vertical side members is at least equal to the vertical height of a container enclosing a supply of disposable bags to be placed in said waste receptacle.

7. A waste receptacle as set forth in claim 1 wherein said platform for supporting disposable bags has a top surface and the height of said at least two radially opposed generally planar second vertical sidewalls relative to the top surface of said platform for supporting disposable bags is greater than the height of a supply of disposable bags to be stored in said waste receptacle.

8. A waste receptacle as set forth in claim 5 wherein the outside edges of said removable platform closely conform to the adjacent portion of said first upwardly extending sidewalls when said removable platform is being supported by said at least one pair of horizontally opposed substantially vertical side members.

9. A waste receptacle as set forth in claim 1 further comprising a removable platform for supporting trash placed in said waste receptacle, said removable platform having a top surface and a bottom surface and a plurality of support members projecting downwardly from said bottom surface and resting on said bottom portion to support said removable platform a predetermined distance above said bottom portion.

10. A waste receptacle as set forth in claim 9 wherein said predetermined distance is at least equal to the height of a container enclosing a supply of disposable bags for containing waste material.

11. A waste receptacle as set forth in claim 10 wherein said plurality of support members comprises at least one pair of axially opposed members spaced apart from each other by a distance not less than a distance between opposing sidewalls of a container enclosing a supply of disposable bags to be placed in said waste receptacle.

12. A waste receptacle as set forth in claim 5 wherein said removable platform has an opening therein through which disposable bags stored in said bag storing volume can be passed into the waste containing volume.

13. A waste receptacle as set forth in claim 11 wherein said at least one pair of axially opposed members comprises two pairs of axially opposed members constructed and arranged to admit with slight clearance a container enclosing a supply of disposable trash bags to be placed in said waste receptacle.

14. A waste receptacle as set forth in claim 13 wherein the outside edges of said removable platform closely conform to the adjacent portions of said first upwardly extending sidewalls when the removable platform is installed in the waste receptacle and said removable platform has an opening therein through which disposable bags stored in said bag storing volume can pass into the waste containing volume.

15. A waste receptacle as set forth in claim 9 wherein the removable platform and the plurality of support members projecting downwardly from said bottom surface are formed as a unitary molded article.

16. A waste receptacle comprising:

a waste containing volume open from the top and defined on its sides by first upwardly extending sidewalls, a bag storing volume at the bottom of said waste receptacle, accessible only through the open top thereof, for storing disposable bags used to contain waste material placed in said waste receptacle, said bag storing volume being defined in part by two pairs of axially opposed generally planar second vertical sidewalls of substantially lesser height than the height of said first upwardly extending sidewalls , each of said second vertical sidewalls extending generally parallel to its axially opposed second vertical sidewall, and a removable platform supported on said second vertical sidewalls in a generally horizontal plane for supporting waste material placed in a bag within said waste receptacle.

17. A waste receptacle as set forth in claim 16 wherein said two pairs of axially opposed generally planar second vertical sidewalls are arranged in a rectangular configuration.

18. A waste receptacle as set forth in claim 17, wherein one pair of said axially opposed generally planar second vertical sidewalls have an arcuate vertical configuration,

* * * * *